US005893253A

United States Patent [19]

Lutz, III

[11] Patent Number: 5,893,253

[45] Date of Patent: Apr. 13, 1999

[54] FLOOR SAG ELIMINATOR

[75] Inventor: Peter J. Lutz, III, Macomb, Mich.

[73] Assignee: E&E Engineering, Inc., Warren, Mich.

[21] Appl. No.: 08/857,779

[22] Filed: May 16, 1997

[51] Int. Cl.[6] ..... E04C 3/30

[52] U.S. Cl. ..... 52/695; 52/291; 52/693; 52/698; 52/741.1; 52/749.1

[58] Field of Search ..... 52/167.3, 291, 52/698, 693, 741.1, 749.1, 695; 248/317, 343

[56] References Cited

U.S. PATENT DOCUMENTS

| | | | |
|---|---|---|---|
| 1,570,496 | 1/1926 | Jones | 248/317 |
| 1,740,727 | 12/1929 | Dunlap | 248/317 X |
| 1,758,934 | 5/1930 | Conrath | 248/317 X |
| 2,181,702 | 11/1939 | Masoner . | |
| 2,532,006 | 11/1950 | Beach . | |
| 2,865,059 | 4/1958 | Scriven . | |
| 3,305,988 | 2/1967 | Halopoff | 52/291 |
| 3,362,117 | 1/1968 | Raden . | |
| 4,038,803 | 8/1977 | Schoeller . | |
| 4,122,647 | 10/1978 | Kovar . | |
| 4,888,926 | 12/1989 | Lutz, III . | |
| 5,105,598 | 4/1992 | Wilcox | 52/693 X |
| 5,301,486 | 4/1994 | Taylor . | |

*Primary Examiner*—Christopher Kent
*Attorney, Agent, or Firm*—Gifford, Krass, Groh, Sprinkle, Patmore, Anderson & Citkowski,P.C.

[57] ABSTRACT

A floor sag eliminator that includes a floor plate assembly which is configured to be fastened to the underside of an existing floor between adjacent joists. One or more support arms are pivotally connected to the floor plate assembly at one of their ends. The other ends of the support arms are configured to engage and be retained by the side walls of floor joists. The support arms cooperate with the floor joists to provide support to the floor and to eliminate the sag.

25 Claims, 3 Drawing Sheets

FLOOR SAG ELIMINATOR

FIELD OF THE INVENTION

This invention relates generally to building hardware and more specifically to apparatus for eliminating floor sag.

BACKGROUND OF THE INVENTION

Ideally the floor of a building is level, flat, and solid. However, sometimes a floor will develop localized sags, dips or weak spots. These may develop due to bad building materials, poor installation, or poor design of the floor. Sags, dips and weak spots may also develop over time as the construction materials age, warp, shrink or the like. Sags, dips, and weak spots may also develop due to overloading or uneven loading of the floor. Sags, dips and weak spots are particularly a problem in modular, manufactured and mobile homes since costs are frequently minimized in these types of construction; therefore, the amount, strength, and quality of the building materials employed are often reduced.

Solid, level, and flat floors are desirable for cosmetic as well as safety reasons. A floor with a localized sag or dip may cause a walker to stumble or fall. A localized weak spot may cause the floor to fail when loaded.

Previous approaches to eliminating floor sag can be divided into preventative approaches and curative approaches. Preventative approaches include using higher quality, and new designs, of building materials. To prevent a sag or dip, a floor should be designed to spread load evenly to the floor joists supporting the floor. Also, the floor joists should be close enough to one another to solidly support the floor. Positioning the floor joists closer to one another lowers the chance of a localized sag or dip. Bracing between floor joists can also be used to improve the distribution of loads. U.S. Pat. No. 2,865,059 to Scriven discloses a metal joist-bridging brace configured to be incorporated during the construction of a floor system. The upper portion of the brace is connected to the top side of the joist and the lower portion of the brace is connected to the underside of the joist; consequently, the braces must be installed before the floor is laid on top of the joists. This brace system cannot be incorporated after a floor system is complete without removing the floor from the joist. This limits the invention to preventative uses only.

Previous curative approaches to fixing localized sags, dips or weak spots that develop after a floor is complete, include hammering in pieces of wood between the joists and positioning jack posts underneath the problem area. These approaches work to eliminate the sag, dip or weak spot, but are time and labor intensive. To fabricate a nail-in wooden support requires woodcutting tools, and some degree of skill. A jack post is simpler to use but can be costly and takes up valuable space in the region below the floor.

There is a need for a simple to use, low cost means to quickly eliminate a localized sag, dip or weak spot in a floor. The present invention provides such a means to eliminate localized sags, dips, and weak spots. It can be added after construction is complete when a problem develops or during original construction to prevent later problems. The device does not require the removal of the floor or the floor covering. As will be described in greater detail hereinbelow, the present invention provides a floor sag eliminator which is affixed to the underside of a floor and connects to adjacent floor joists to provide support to the floor thereby eliminating a localized sag, dip or weak spot.

BRIEF DESCRIPTION OF THE INVENTION

There is disclosed herein a floor sag eliminator for providing support to the underside of a floor in the location of a localized sag, dip or weak spot. The floor sag eliminator includes a floor plate assembly which can be inserted between existing floor joists and be affixed to the underside of the floor. A support arm extends from the plate assembly at an angle and is configured to engage one of the floor joists. Some embodiments of the present invention include a second support arm which also extends from the floor plate assembly at an angle, and engages another floor joist. Some embodiments include a built in nailer on one end of the support arm that engages the joist when the built in nailer is positioned against the side wall of the joist. Also disclosed is a method of using the present invention for providing support to the underside of a floor in the location of a localized sag, dip or weak spot.

DETAILED DESCRIPTION OF THE DRAWINGS

Figure 1:
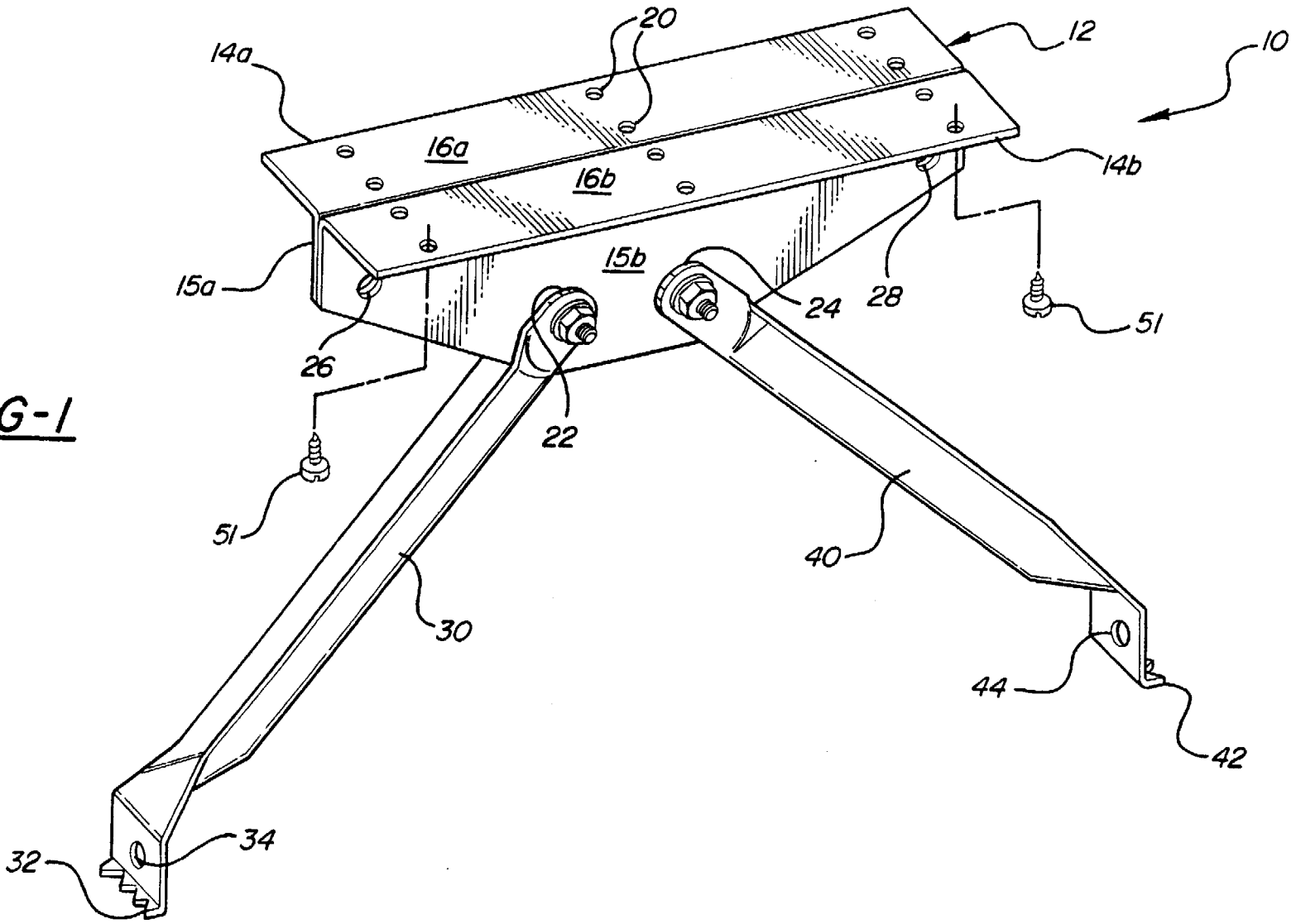
FIG. 1 is a perspective view of a floor sag eliminator according to the present invention.

Referring to FIG. 1, one embodiment of a floor sag eliminator according to the present invention is generally shown at 10. The sag eliminator 10 includes a floor plate assembly 12 which in this embodiment is made up of a first L-shaped member **14*a* and a second L-shaped member 14*b*. Each L-shaped member, 14*a* and 14*b*, includes a connection portion, 15*a* and 15*b*, and an attachment portion 16*a* and 16*b*. The attachment portions 16*a* and 16*b* include a plurality of holes 20 defined therethrough, and the floor plate assembly can be attached to the underside of a floor by passing fasteners, such as screws 51, through the holes 20 of the attachment portions, 16*a* and 16*b*, and into the underside of the floor. The connection portions 15*a* and 15*b* of the L-shaped members 14*a* and 14*b* include at least two connection points 22 and 24 defined by holes therethrough. The connection portions 15*a* and 15*b* may also include additional connection points 26 and 28**.

A first rigid support arm 30 has a first end which is pivotally connected to one of the connection points 22. The second end of the support arm 30 is configured to engage a floor joist. The support arm 30 includes at least one tooth 32 which functions as a built in nailer for the second end of the support arm 30. The provision of the built in nailer allows the second end of the support arm to engage the joist temporarily or permanently without the addition of any separate fasteners. The second end of the support arm 30 is also provided with a hole 34 defined therethrough. The hole 34 allows a fastener such as a nail or screw to be used to affix the second end of the support arm 30 to the joist. The illustrated embodiment of floor sag eliminator also includes a second rigid support arm 40 having a first end pivotally connected to a second connection point 24 and a second end having at least one tooth 42 and a hole 44 defined therethrough.

Figure 2:
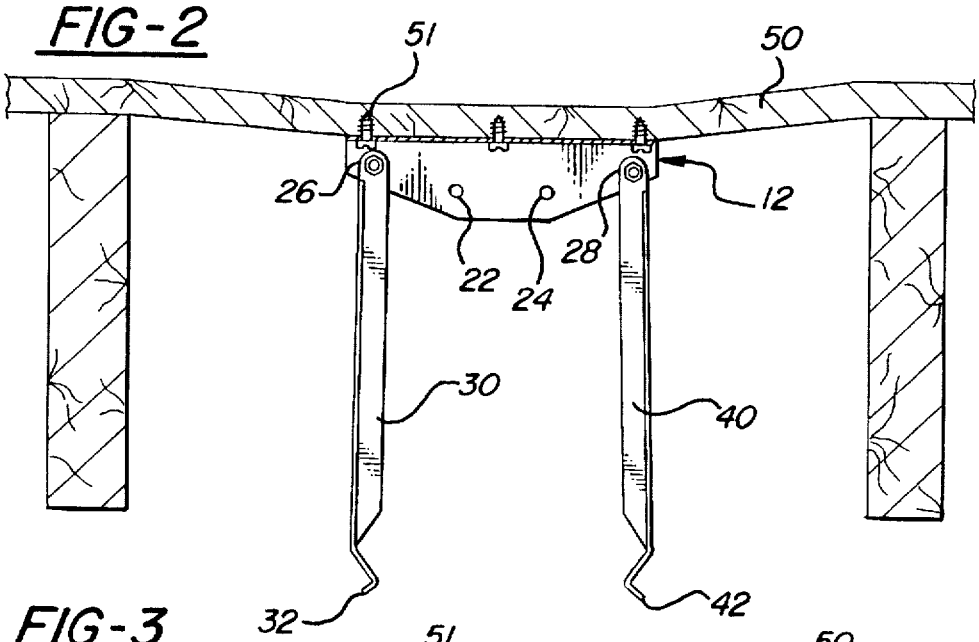
FIG. 2 is a front elevational view of the sag eliminator after the floor plate assembly has been attached to the underside of a floor.
Figure 3:
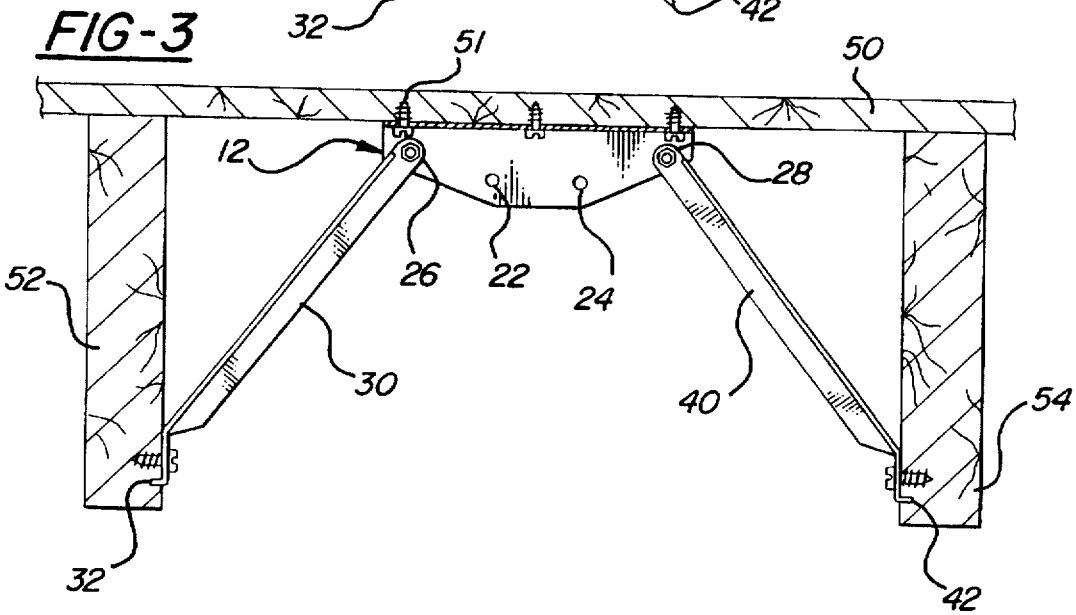
FIG. 3 is a front elevational view of the sag eliminator as installed where a floor is supported by eight inch tall floor joists.

Operation of the floor sag eliminator is illustrated in FIGS. 2 and 3. Referring now to FIG. 2, the floor sag eliminator of FIG. 1 is shown with the floor plate assembly 12 attached to the underside of a floor 50. In use, a person first locates a position where a floor 50 sags, dips or has a weak spot. The position of the sag can be located using a level, a marble, or a variety of other approaches. Once the sag has been located, the corresponding position of the sag should be located on the underside of the floor 50. This can be done by having one person feel along the underside of the floor 50 while an assistant taps on the upper side of the floor 50 at the location of the dip or sag using their knuckles or a rubber mallet. Next, the sag eliminator 10 is positioned near the location of the sag and the floor plate assembly 12 is fastened to the underside of the floor 50. Preferably, the support arms 30 and 40 are connected to the floor plate assembly 12 prior to affixing the floor plate assembly 12 to the underside of the floor 50. Alternatively, the floor plate assembly 12 can first be attached to the underside of the floor and then the arms 30 and 40 can be connected to the floor plate assembly 12. The floor plate assembly 12 is fastened to the underside of the floor 50 using a plurality of screws 51, although nails or other fasteners can also be employed.

Referring now to FIG. 3 the floor sag eliminator 10 is shown as installed after the floor plate assembly 12 is attached to the underside of the floor 50. The support arms 30 and 40 are swung up so that the second ends of the support arms 30 and 40 engage the sidewalls of joists 52 and 54. The second ends of the support arms 30 and 40 can be tapped upwardly with a hammer until the sag has been eliminated. As the second ends of the support arms 30 and 40 are tapped upwardly, the teeth 32 and 42 engage the side walls of the joists 52 and 54. If the second end of either of the support arms, 30 or 40, is tapped too far upwardly, it may create a bulge in the floor 50. If this occurs, the second end of the support arm, 30 or 40, can be pried away from the joist 52 or 54 and repositioned. Once the support arms 30 and 40 are properly positioned and the sag is eliminated, nails or screws can be affixed through holes 34 and 44 into the side walls of the joists 52 and 54. The nails or screws more securely affix the second ends of the arms 30 and 40 to the joists 52 and 54.

Figure 4:
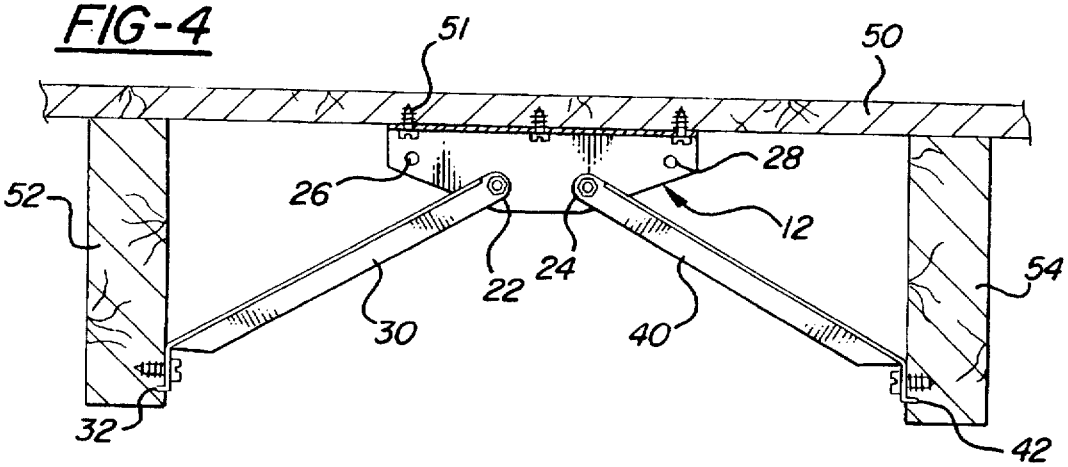
FIG. 4 is a front elevational view of the sag eliminator as installed where a floor is supported by six inch tall floor joists.

The sag eliminator of the present invention can be adjusted to accommodate different sizings and spacings of floor joists. FIG. 3 shows the sag eliminator as attached to a floor having eight inch floor joists 52 and 54 and in this installation the support arms 30 and 40 are pivotally connected to the outermost connection points 26 and 28. FIG. 4 shows the sag eliminator 10 installed where the floor 50 is supported by six inch floor joists 52 and 54. The support arms 30 and 40 are pivotally connected to the innermost connection points 22 and 24 of the floor plate assembly 12.

Other variations of the floor sag eliminator are possible and contemplated within the scope hereof. The preferred embodiment of the present invention includes two support arms 30 and 40 to allow the sag eliminator 10 to gain support from two joists. In the alternative, the sag eliminator 10 can be used with only one arm thereby gaining support from only one joist. This simplified version would be especially useful where only one floor joist is easily accessible. The support arms 30 and 40 preferably are of the same length making them interchangeable and simplifying manufacturing. However, arms of differing lengths could be used if a particular application called for this configuration. The sag eliminator could also be constructed with more than two arms and have a correspondingly increased number of attachment points to the floor plate assembly. The support arms 30 and 40 are preferably stamped from sheet metal with a cross-section that enhances their rigidity. The most preferred embodiment has a V-shaped cross-section in the midportion of the support arms 30 and 40.

Figure 5:
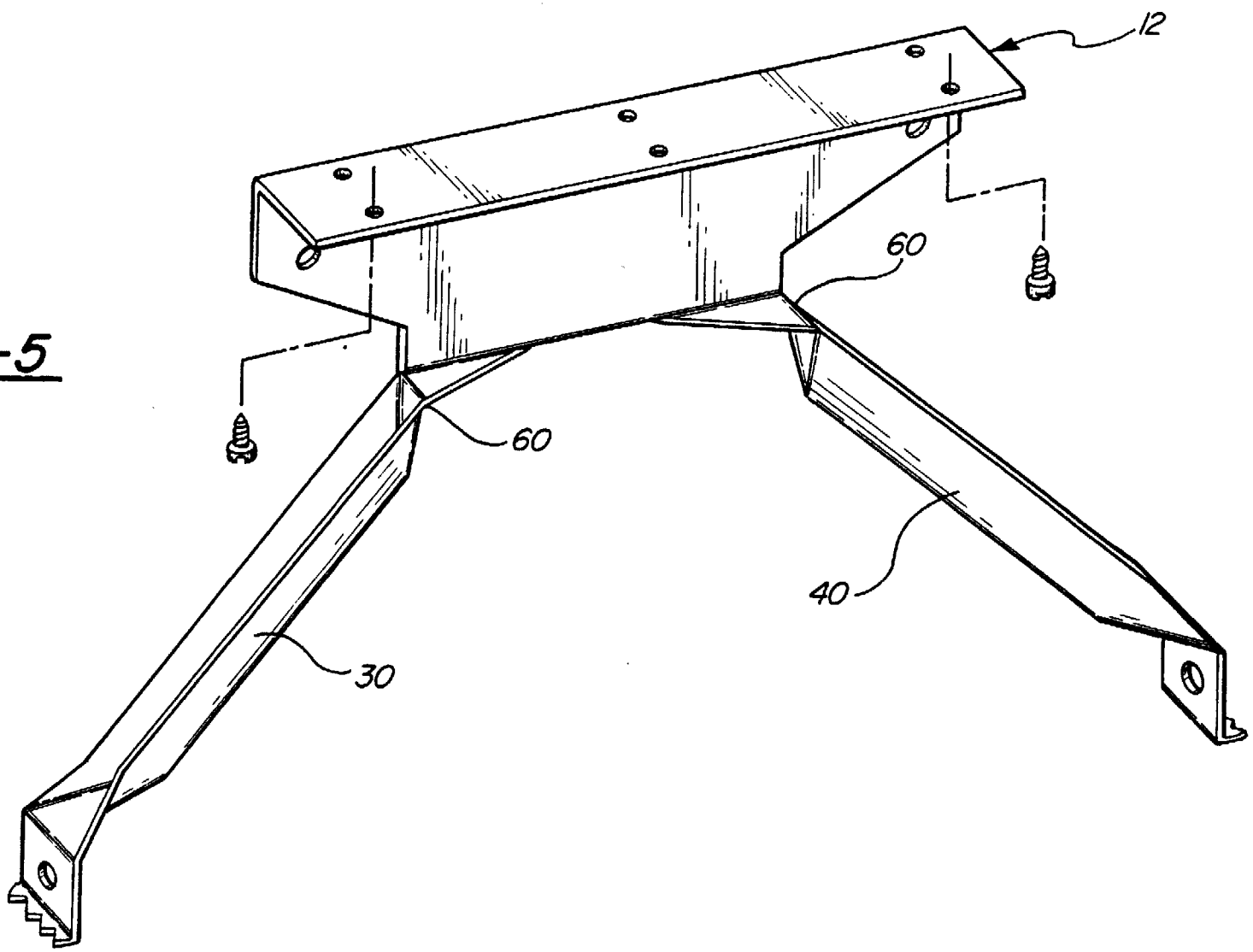
FIG. 5 is a perspective view of a floor sag eliminator according to the present invention including a living hinge.

The L-shaped members 14*a* and 14*b* are preferably made of metal but could also be formed from an engineering thermoplastic or any other material with sufficient rigidity. A metal stamping is usually preferred because of the material's low cost, strength, and rigidity. The L-shaped configuration of the two members 14*a* and 14*b* is generally preferred because the shape simplifies tooling, although other configurations of plate could be used in the present invention. For example, the floor plate assembly 12 could alternatively be formed from one stamped piece of material or molded in one piece from a material having sufficient rigidity. The support arms 30 and 40 could alternatively be rigidly connected to the floor plate assembly 12 and extend away from the assembly 12 at the desired angle for a particular application; however, a pivotal connection is preferred to improve ease of use and allow the same parts to be used in a multitude of applications. As shown in FIG. 5, the arms 30 and 40 could also be connected to the floor plate assembly 12 through living hinges 60 defined by an integral portion of the assembly, in which instance the support arms 30 and 40 will be stamped as part of the floor plate assembly.

In view of the teaching presented herein, other modifications and variations of the present inventions will be readily apparent to those of skill in the art. The foregoing drawings, discussion, and description are illustrative of some embodiments of the present invention; but are not meant to be limitations on the practice thereof. It is the following claims, including all equivalents, which define the scope of the invention.

I claim:

1. A floor sag eliminator, comprising:

a floor plate assembly configured to be disposed between adjacent joists of an existing floor, said plate assembly including an attachment portion for affixing said plate assembly to an underside of a floor; and a support arm having a first end which is pivotally connected to said floor plate assembly and a second end which is configured to engage and be retained by one of the adjacent joists; whereby said support arm cooperates with the joist to provide support to the floor;

said plate assembly further including a connection portion for establishing connection to said first end of said support arm, said connection portion including at least 2 connection points.

2. A floor sag eliminator according to claim 1, wherein said attachment portion includes a plurality of holes defined therethrough, each of said holes configured to receive a fastener for affixing said floor plate assembly to the underside of the floor.

3. A floor sag eliminator according to claim 1, wherein said support arm is pivotally connected to said floor plate assembly by a living hinge.

4. A floor sag eliminator according to claim 1, wherein said second end of said support arm includes at least one tooth for engaging the joist.

5. A floor sag eliminator according to claim 1, wherein said second end of said support arm has a hole defined therethrough, said hole configured to receive a fastener for affixing said second end to the joist.

6. A floor sag eliminator according to claim 1, wherein said support arm has an axial stiffening rib.

7. A floor sag eliminator according to claim 1, wherein said support arm is configured to engage and be retained by a side wall of said joist.

8. A floor sag eliminator, comprising:

a floor plate assembly configured to be disposed between adjacent joists of an existing floor, said plate assembly including an attachment portion for affixing said plate assembly to an underside of a floor;

a first support arm having a first end which is pivotally connected to said floor plate assembly and a second end which is configured to engage and be retained by one of the adjacent joists; whereby said first support arm cooperates with the joist to provide support to the floor; and a second support arm having a first end which is pivotally connected to said floor plate assembly and a second end which is configured to engage and be retained by a second one of the adjacent joists; whereby said second support arm cooperates with the second joist to provide support to the floor.

9. A floor sag eliminator according to claim 8, wherein said plate assembly further includes a connection portion for establishing connection to said first end of said support arm.

10. A floor sag eliminator according to claim 9, wherein said connection portion is disposed at right angles to said attachment portion.

11. A floor sag eliminator according to claim 8, wherein said attachment portion includes a plurality of holes defined therethrough, each of said holes configured to receive a fastener for affixing said floor plate assembly to the underside of the floor.

12. A floor sag eliminator according to claim 8, wherein said support arms are each pivotally connected to said floor plate assembly by a living hinge.

13. A floor sag eliminator according to claim 8, wherein said second end of each of said support arms includes at least one tooth for engaging the corresponding joist.

14. A floor sag eliminator according to claim 8, wherein said second end of each of said support arms has a hole defined therethrough, said hole configured to receive a fastener for affixing said second end to the corresponding joist.

15. A floor sag eliminator according to claim 8, wherein each of said support arms has an axial stiffening rib.

16. A floor sag eliminator according to claim 8, wherein said support arms are configured to engage and be retained by side walls of said corresponding joists.

17. A floor sag eliminator, comprising:

a floor plate assembly configured to be disposed between adjacent joists of an existing floor, said plate assembly including an attachment portion for affixing said plate assembly to an underside of a floor; and a support arm having a first end which is pivotally connected to said floor plate assembly and a second end which is configured to engage and be retained by one of the adjacent joists; whereby said support arm cooperates with the joist to provide support to the floor;

said floor plate assembly comprising a first and a second generally L-shaped member, each L-shaped member including a first leg configured for attachment to the underside of the floor and a second leg generally perpendicular to said first leg, said first end of said support arm being pivotally connected to said second leg of said first and said second member.

18. A floor sag eliminator according to claim 17, wherein said attachment portion includes a plurality of holes defined therethrough, each of said holes configured to receive a fastener for affixing said floor plate assembly to the underside of the floor.

19. A floor sag eliminator according to claim 17, wherein said second end of said support arm includes at least one tooth for engaging the joist.

20. A floor sag eliminator according to claim 17, wherein said second end of said support arm has a hole defined therethrough, said hole configured to receive a fastener for affixing said second end to the joist.

21. A floor sag eliminator according to claim 17, wherein said support arm has an axial stiffening rib.

22. A floor sag eliminator according to claim 17, wherein said support arm is configured to engage and be retained by a side wall of said joist.

23. A floor sag eliminator, comprising:

a floor plate assembly configured to be disposed between adjacent joists of an existing floor, said plate assembly comprising a generally L-shaped member including a first leg configured for attachment to the underside of the floor and a second leg generally perpendicular to said first leg, said second leg including a connection portion with at least 2 connection points defined thereupon;

a first support arm having a first end which is pivotally connected to one of said connection points and a second end which is configured to engage and be retained by a first one of the adjacent joists, said second end including at least one tooth for engaging a side wall of the first joist and a hole defined therethrough, said hole configured to receive a fastener for affixing said second end to the joist; and a second support arm having a first end which is pivotally connected to a second one of said connection points and a second end which is configured to engage and be retained by a second one of the adjacent joists, said second end including at least one tooth for engaging the second joist and a hole defined therethrough, said hole configured to receive a fastener for affixing said second end of said second arm to the second joist; whereby said arms cooperate with the joists to provide support to the floor.

24. A method for eliminating a sag in a floor, comprising the steps of:

providing a floor sag eliminator comprising a floor plate assembly configured to be disposed between adjacent joists of an existing floor, said plate assembly including an attachment portion for affixing said plate assembly to an underside of a floor; and a support arm having a first end which is pivotally connected to said floor plate assembly and a second end which is configured to engage and be retained by one of the adjacent joists;

affixing said floor plate assembly to the underside of a floor between adjacent joists thereof;

exerting pressure against the underside of the floor to remove the sag; and engaging said second end of said support arm to one of the joists thereby supporting the floor by the cooperation of said support arm with the joist.

25. A method for eliminating a sag in an existing floor, comprising the steps of:

providing a floor sag eliminator comprising a floor plate assembly configured to be disposed between adjacent joists of a floor, said plate assembly comprising a generally L-shaped member including a first leg configured for attachment to the underside of the floor and a second leg generally perpendicular to said first leg, said second leg including a connection portion with at least 2 connection points defined thereupon; a first support arm having a first end which is pivotally connected to one of said connection points and a second end which is configured to engage and be retained by a first one of the adjacent joists, said second end including at least one tooth for engaging the first joist, and a hole defined therethrough, said hole configured to receive a fastener for affixing said second end to the first joist; and a second support arm having a first end which is pivotally connected to a second one of said connection points and a second end which is configured to engage and be retained by a second one of the adjacent joists, said second end including at least one tooth for engaging the second joist, and a hole defined therethrough, said hole configured to receive a fastener for affixing said second end of said second arm to the second joist;

affixing said first leg of said floor plate assembly to the underside of the floor between said adjacent joists;

exerting pressure against the underside of the floor to remove the sag; and engaging said second end of said first support arm to the first joist by embedding said at least one tooth into a side wall of the first joist;

engaging said second end of said second support arm to the second joist by embedding said at least one tooth into a side wall of the second joist;

affixing said second end of said first support arm to the first joist by inserting a fastener through said hole in said second end of said first support arm and affixing the fastener into the first joist; and affixing said second end of said second support arm to the second joist by inserting a fastener through said hole in said second end of said second support arm and affixing the fastener into the second joist; thereby supporting the floor by the cooperation of said support arms with the joists.

* * * * *